US008807255B2

(12) United States Patent
Marsolek et al.

(10) Patent No.: US 8,807,255 B2
(45) Date of Patent: Aug. 19, 2014

(54) ENGINE HOT AIR DEFLECTOR

(71) Applicants: John L. Marsolek, Watertown, MN (US); Jeffrey A. Renard, Hugo, MN (US)

(72) Inventors: John L. Marsolek, Watertown, MN (US); Jeffrey A. Renard, Hugo, MN (US)

(73) Assignee: Caterpillar Paving Products Inc., Minneapolis, MN (US)

( * ) Notice: Subject to any disclaimer, the term of this patent is extended or adjusted under 35 U.S.C. 154(b) by 142 days.

(21) Appl. No.: 13/625,838

(22) Filed: Sep. 24, 2012

(65) Prior Publication Data

US 2014/0083786 A1 Mar. 27, 2014

(51) Int. Cl.
*B60K 11/00* (2006.01)

(52) U.S. Cl.
USPC ..... 180/68.1; 404/122

(58) Field of Classification Search
USPC ..... 180/68.1, 68.2, 89.12, 21–231; 280/479.2; 165/41, 42; 404/122; 277/600, 631, 642, 921
See application file for complete search history.

(56) References Cited

U.S. PATENT DOCUMENTS

| | | | | | |
|---|---|---|---|---|---|
| 1,679,498 | A * | 8/1928 | Richardson | ..... | 180/90.6 |
| 1,728,306 | A * | 9/1929 | Richardson | ..... | 180/90.6 |
| 3,683,763 | A * | 8/1972 | Keppler et al. | ..... | 404/117 |
| 4,191,064 | A * | 3/1980 | Houk et al. | ..... | 74/473.23 |
| 4,389,757 | A * | 6/1983 | Luck et al. | ..... | 24/438 |
| 4,603,878 | A * | 8/1986 | Smith, Jr. | ..... | 280/479.2 |
| 4,878,544 | A * | 11/1989 | Barnhart | ..... | 172/40 |
| 7,077,240 | B2 * | 7/2006 | Itoh et al. | ..... | 187/249 |
| 2003/0118401 | A1 * | 6/2003 | Magee et al. | ..... | 404/117 |
| 2006/0034659 | A1 * | 2/2006 | Magee | ..... | 404/117 |
| 2008/0267707 | A1 * | 10/2008 | Potts et al. | ..... | 404/117 |
| 2011/0070023 | A1 * | 3/2011 | Potts et al. | ..... | 404/72 |
| 2012/0067432 | A1 * | 3/2012 | Vigholm et al. | ..... | 137/14 |
| 2012/0114416 | A1 * | 5/2012 | Marsolek et al. | ..... | 404/75 |
| 2013/0248556 | A1 * | 9/2013 | May | ..... | 222/1 |
| 2013/0259570 | A1 * | 10/2013 | Thiesse | ..... | 404/75 |

* cited by examiner

*Primary Examiner* — Hau Phan
*Assistant Examiner* — Jacob Meyer
(74) *Attorney, Agent, or Firm* — Miller, Matthias & Hull

(57) ABSTRACT

An engine hot air deflector for a work machine having an articulated frame pivotally coupled to a main body by a hitch assembly having a hitch link includes a resilient hot air deflector panel mounted proximate to and overlaying an open end of the main body. The deflector panel includes upper and lower panel portions separated by a panel slot. The panel slot receives the hitch link so that the panel portions conform to the shape of the hitch link as it moves within the deflector opening during rotation of the articulated frame to substantially prevent hot air from the internal combustion engine from passing through the deflector opening. The deflector may also include a support bracket mounting the deflector panel to the main body.

19 Claims, 2 Drawing Sheets

ENGINE HOT AIR DEFLECTOR

TECHNICAL FIELD

This disclosure relates generally to the engine heat disbursed by work machines having articulated steering mechanisms and, more particularly, to an engine hot air defector for diverting engine heat away from an operator station of the work machine during use.

BACKGROUND

Internal combustion engines in work machines generate heat when executing the combustion cycle as the work machine is operated to perform a work task. The heat from the engine must be dissipated so that the engine does not overheat and damage the components of the engine. Some heat is drawn from the engine coolant flowing through the engine, absorbing heat from the engine, and dissipating the heat at a heat exchanging element. However, heat is also dissipated by being transferred to the ambient atmosphere surrounding the engine. Where the engine is enclosed in an engine compartment, the hot air surrounding the engine must be vented to the exterior of the engine compartment so that the engine compartment does not in turn overheat.

The operator station in which the operator is disposed when operating the work machine is typically in proximity to the engine compartment and to the air vents and other release openings from the hot air from the engine compartment. Many work machines have enclosed operator stations, and may provide climate control features (air conditioning, heat, etc.), so that the operator is provided with a measure of shelter and isolation from the surrounding atmosphere. However, many other work machines do not have enclosed operator stations, and the operators are exposed to the elements, including the hot air venting from the engine compartment. The venting configuration of the work machine may be tailored to direct the hot air away from the work machine so that, to the extent possible, the hot air does not enter the operator station. Difficulties in controlling the direction of disbursement of the hot air can arise where the hot air vents from the engine compartments in areas where moving components of the work machine are present. The moving components can make it difficult to position air flow control structures to reliably direct the hot air away from the operator station. In view of this, a need exists for improved structures for directing vented air flow in work machines where hot air from the engine compartment is vented to open areas where moving components of the work machine are present.

SUMMARY OF THE DISCLOSURE

In one aspect of the present disclosure, the invention is directed to an engine hot air deflector for a work machine having a main body with an internal combustion engine disposed therein, and an articulated steering mechanism including an articulated frame pivotally coupled to the main body by a hitch assembly having a hitch link pivotally connected between the main body and the articulated frame and extending through an open end of the main body. The engine hot air deflector may include a resilient hot air deflector panel configured to be mounted to the main body proximate the open end. The deflector panel may include an upper panel portion, a lower panel portion and a panel slot there between configured to receive the hitch link there through so that the upper panel portion and the lower panel portion conform to the shape of the hitch link as the hitch link moves within the open end of the main body during rotation of the articulated frame to steer the work machine to substantially prevent hot air from the internal combustion engine from passing through the open end of the main body.

In another aspect of the present disclosure, the invention is directed to a work machine having a main body with an open end, an internal combustion engine disposed within the main body, an articulated steering mechanism having an articulated frame, a hitch assembly pivotally coupling the articulated frame to the main body, and a hitch link pivotally connected between the main body and the articulated frame and extending through the open end of the main body. The work machine may further include an engine hot air deflector that may have a resilient hot air deflector panel mounted to the main body proximate the open end and overlaying the open end of the main body. The deflector panel may include an upper panel portion, a lower panel portion and a panel slot there between configured to receive the hitch link there through so that the upper panel portion and the lower panel portion conform to the shape of the hitch link as the hitch link moves within the open end of the main body during rotation of the articulated frame to steer the work machine to substantially prevent hot air from the internal combustion engine from passing through the open end of the main body.

Additional aspects of the invention are defined by the claims of this patent.

DETAILED DESCRIPTION

Although the following text sets forth a detailed description of numerous different embodiments of the invention, it should be understood that the legal scope of the invention is defined by the words of the claims set forth at the end of this patent. The detailed description is to be construed as exemplary only and does not describe every possible embodiment of the invention since describing every possible embodiment would be impractical, if not impossible. Numerous alternative embodiments could be implemented, using either current technology or technology developed after the filing date of this patent, which would still fall within the scope of the claims defining the invention.

It should also be understood that, unless a term is expressly defined in this patent, there is no intent to limit the meaning of that term, either expressly or by implication, beyond its plain or ordinary meaning, and such term should not be interpreted to be limited in scope based on any statement made in any section of this patent (other than the language of the claims). To the extent that any term recited in the claims at the end of this patent is referred to in this patent, in a manner consistent with a single meaning, that is done for sake of clarity only so as to not confuse the reader, and it is not intended that such claim term be limited, by implication or otherwise, to that single meaning.

Figure 1:
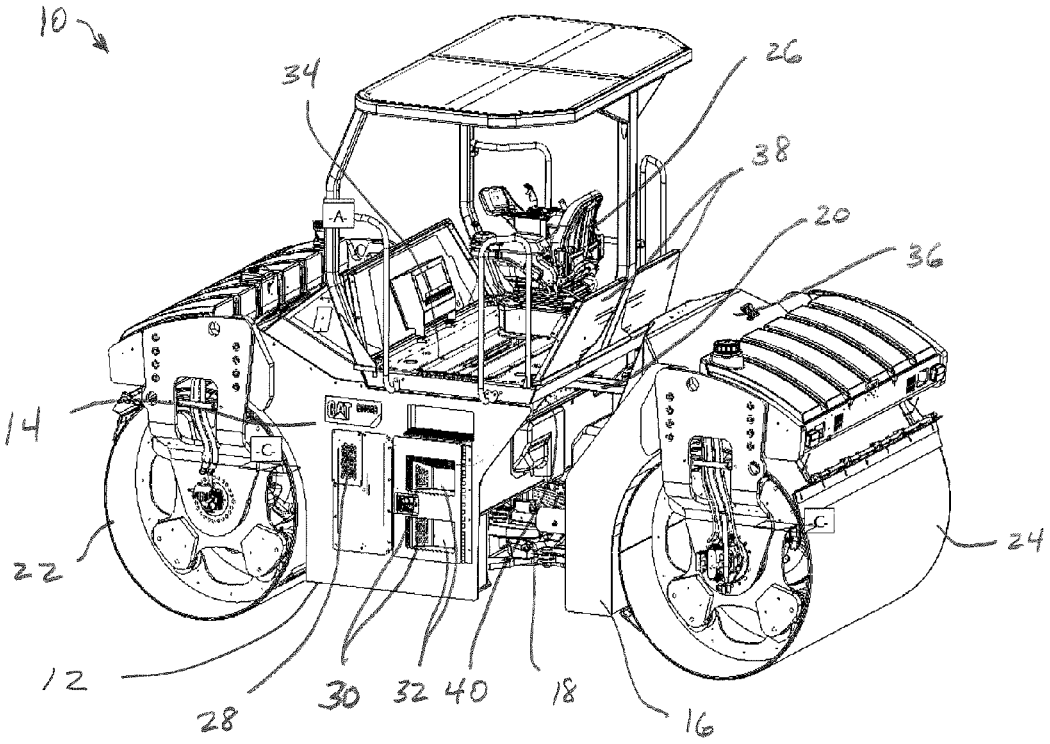
FIG. 1 is perspective view of a work machine in the form of an articulated steering vibratory compactor having a hot air deflector assembly in accordance with the present disclosure.

FIG. 1 is an exemplary work machine 10 in the form of a vibratory compactor that includes an internal combustion engine (not shown) generating hot air as the engine executes the combustion cycle to provide power for operation of the work machine 10. The work machine 10 includes a main body 12 having an engine housing 14 enclosing the engine, and an articulated frame 16 rotatably connected to the main body 12 by a bottom hitch assembly 18. A top hitch link 20 provides support, at an upper end of the articulated frame 16, and is pivotally connected at one end to the main body 12 and at the opposite end to the articulated frame 16. The work machine 10 is supported by a front drum 22 rotatably mounted on the main body 12 and driven by a powertrain (not shown) operatively coupling the front drum 22 to the engine, and by a rear drum 24 rotatably mounted on the articulated frame 16. The work machine 10 may be steered via the bottom hitch assembly 18 by rotating the articulated frame 16 to the left or right in response to commands from an operator in an operator station 26 to cause the work machine 10 to turn in the desired direction. As the bottom hitch assembly 18 rotates the articulated frame 16, the top hitch link 20 moves from side-to-side with the articulated frame 16, and may move through arc-shaped path in a manner discussed more fully below.

The work machine 10 is illustrated as a vibratory compactor having drums 22, 24 for translating the work machine 10 over a work surface. However, those skilled in the art will understand that engine hot air deflectors as will be discussed more thoroughly hereinafter may have application in other types of work machines having articulated steering mechanisms. For example, work machines such as wheel loaders, bulldozers, articulated trucks and the like may include, articulated frames that are rotated to steer the work machines. Moreover, such work machines may be supported by wheels, tracks and the like as alternatives to the drums 22, 24 implemented in the vibratory compactor. The implementation of the engine hot air deflectors as discussed herein in such alternative work machines having articulated steering mechanisms is contemplated by the inventor where appropriate The engine must receive air to be able to execute the combustion cycle. Consequently, the engine housing 14 includes one or more air intake vents 28 placing the interior of the engine housing 14 in fluid communication with the ambient atmosphere surrounding the main body 12 to receive air for use by the engine. At the same time, the combustion cycle produces hot air in the form of exhaust, and transfers generated heat to the air surrounding the engine within the engine housing 14. The exhaust and hot air must be vented from the engine housing 14 to prevent the engine from overheating and having engine components damaged. The hot air may be vented to the sides of the work machine 10 by hot air vents 30 such as those shown integrated into the steps 32 leading to the operator station 26. Similar vents may be provided in the opposite side of the engine housing 14.

In work machines 10 such as the illustrated vibratory compactor, hot air may be vented at the rear of the main body 12. Hot air vents (not shown) may be provided below an operator station floor 34 so that hot air exits to the rear through open space provided for the top hitch link 20 to move freely from side-to-side. The hot air venting from under the operator station floor 34 may discharge to the sides of the articulated frame 16, and a portion of the hot air may be redirected upwardly by the articulated frame 16 and a rear water tank 36 of a water spray system (not shown) mounted on the articulated frame 16. The upwardly directed hot air may generally rise vertically. Due to the proximity of the operator station 26 that, as illustrated, is not enclosed and isolated from the elements, hot air deflector plates 38 may be mounted proximate the rear of the main body 12. The hot air deflector plates 38 may be angled rearwardly to direct the upwardly rising hot air rearwardly and away from the operator station 26. Even with the rearward direction provided by the hot air deflector plates 38, hot air may still enter the operator station 26, especially in conditions where the work machine 10 is being driven rearward, and where the wind is blowing from the rear of the work machine 10, and thereby making operation of the work machine 10 uncomfortably hot for the operator.

Figure 2:
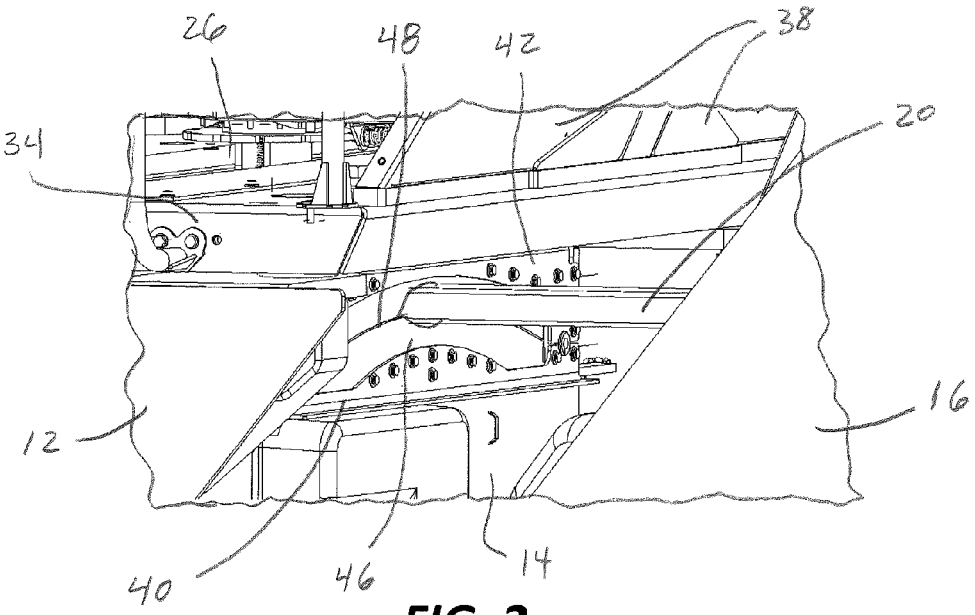
FIG. 2 is an enlarged view of a hitch link and the hot air deflector assembly of the vibratory compactor of FIG. 1.

To further shield the operator station 26 from the rearwardly discharged hot air, the main body 12 may include a further engine hot air deflector 40 covering the open space for the top hitch link 20 to substantially prevent the hot air from being discharged rearwardly without interfering with the movement of the top hitch link 20 when the articulated frame 16 turns. Turning to FIG. 2, which is an enlarged view of the rear portion of the main body 12, the engine hot air deflector 40 is installed over the open space for the top hitch link 20, and includes a support bracket 42 having a deflector opening 44 through which the top hitch link 20 passes, with the deflector opening 44 being dimensioned to allow free movement of the top hitch link 20 therein. The engine hot air deflector 40 may further include a resilient deflector panel 46 overlaying the deflector opening 44 and having a panel slot 48 through which the top hitch link 20 passes. Due to the resiliency of the material from which the deflector panel 46 is fabricated, the deflector panel 46 generally conforms to the shape of the top hitch link 20 to substantially prevent the hot air venting under the operator station floor 34 from passing through the deflector opening 44.

Figure 3:
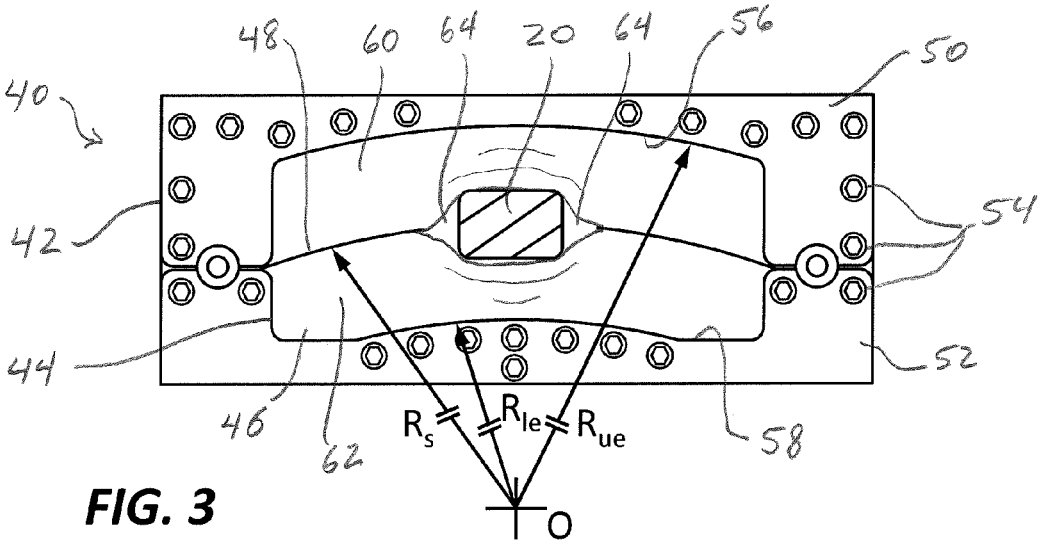
FIG. 3 is a front view of the hot air deflector assembly of the vibratory compactor of FIG. 1 with the hitch link in a central position.

FIG. 3 illustrates an embodiment of the engine hot air deflector 40 in greater detail. The engine hot air deflector 40 as shown has a generally planar, rectangular shape. However, the engine hot air deflector 40 may be fabricated with any appropriate shape necessary to cover the open space in which the top hitch link 20 is disposed. The engine hot air deflector 40 may completely enclose the open space, or may at a minimum be configured to substantially prevent the hot air from being directed rearwardly while allowing hot air to vent to the sides of the main body 12 and away from the operator station 26. To facilitate installation of the engine hot air deflector 40, either during assembly of the work machine 10 or as an aftermarket component installed without requiring disassembly of the top hitch link 20, the support bracket 42 may be provided as an upper bracket portion 50 and a lower bracket portion 52 that may be assembled around the top hitch link 20 and secured to the main body 12 by a plurality of fasteners 54. The upper bracket portion 50 may define an upper edge 56 of the deflector opening 44, and the lower bracket portion 52 may define a lower edge 58 of the deflector opening 44. The upper edge 56 and lower edge 58 may have any appropriate shapes to allow free movement of the top hitch link 20. For example, the edges 56, 58 may have curved shapes corresponding to an arc-shaped movement of the top hitch link 20 as described in greater detail below.

The resilient deflector panel 46 overlays the deflector opening 44, includes an upper panel portion 60 and a lower panel portion 62 separated by the panel slot 48. As with the support bracket 42, the deflector panel 46 may be configured for installation at the time of assembly of the work machine 10, after assembly of the work machine 10 without removal of the top hitch link 20, or both. Consequently, the upper panel portion 60 and the lower panel portion 62 may be fabricated from a single piece of resilient material with the panel slot 48 be cut in the piece of material, or the panel portions 60, 62 may each be formed from a separate pied of resilient material and separated by the panel slot 48 when assembled.

The deflector panel 46 may be formed from any appropriate resilient material that is capable of deflecting and then returning to its original shape. The resiliency of the material may also allow the panel portions 60, 62 to surround the top hitch link 20 and conform to the shape of the top hitch link 20 so that minimally-sized gaps 64 exists around the top hitch link 20 to substantially prevent hot air from the internal combustion engine from passing through the deflector opening 44. Appropriate elastomeric materials may include elastomeric materials such as natural and synthetic rubbers, other polymer materials, textiles and the like capable of deflecting and conforming to the shape of the top hitch link 20. During assembly, the outward portions of the deflector panel 46 are engaged by the support bracket 42 and/or the fasteners 54 to secure the deflector panel 46 in place overlaying the deflector opening 44. The deflector panel 46 may, also be compressed between the support bracket 42 and corresponding portions of the main body 12 to retentively secure the deflector panel 46 in place. The deflector panel 46 may further be secured and retained in alignment with the support bracket 42 via an adhesive applied to facing surfaces of the deflector panel 46 and support bracket 42. Where the engine hot air deflector 40 is installed after assembly of the work machine 10, the upper panel portion 60 may be secured to the upper bracket portion 50 as a first component, and the lower panel portion 62 may be secured to the lower bracket portion 52 as a second component, with the first and second components being assembled around the installed top hitch link 20.

Industrial Applicability

The engine hot air deflector 40 as illustrated and described above covers the open area at the back of a work machine 10 provided to allow the top hitch link 20 to move during rotation of the articulated frame 16. The top hitch link 20 passes through the deflector opening 44, but is substantially encircled and enclosed by the resilient deflector panel 46. With this configuration, the hot air from the engine is substantially prevented from being discharged to the rear of the work machine 10, save for the portion that may vent through the gaps 64 around the top hitch link 20, so that the amount of hot air that may enter the operator station 26 is greatly reduced. Instead, the hot air that cannot discharge through the rearward open space will be redirected out of the engine housing 14 through the lateral hot air vents 30. In alternative embodiments, the support bracket 42 may be omitted and the resilient deflector panel 46 may be mounted to the main body 12 proximate the rearward open end of the main body 12 through which the top hitch link 20 passes. In such embodiments, the main body 12 may be configured with surfaces to which the deflector panel 46 may be mounted, or the deflector panel 46 may be shaped to conform and mount to the existing surfaces of the main body 12.

Figure 4:
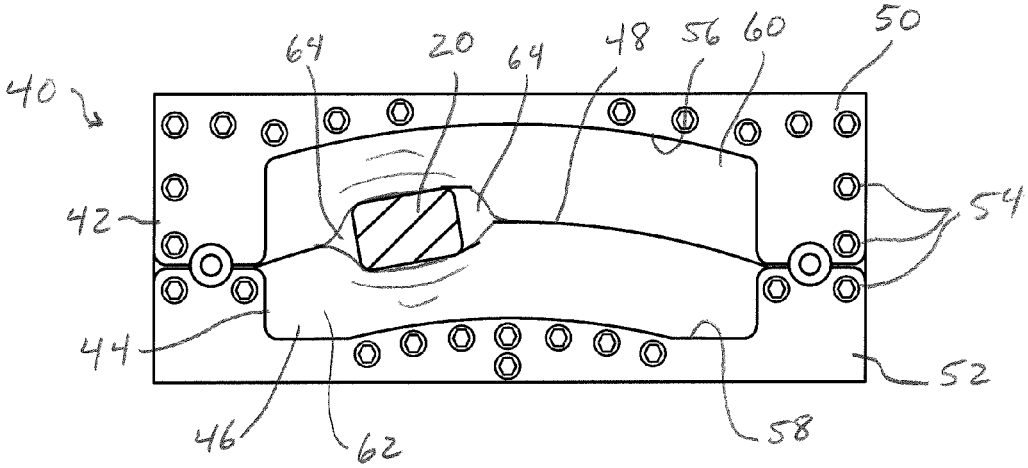
FIG. 4 is a front view of the hot air deflector assembly of the vibratory compactor of FIG. 1 with the hitch link in a left turn position.
Figure 5:
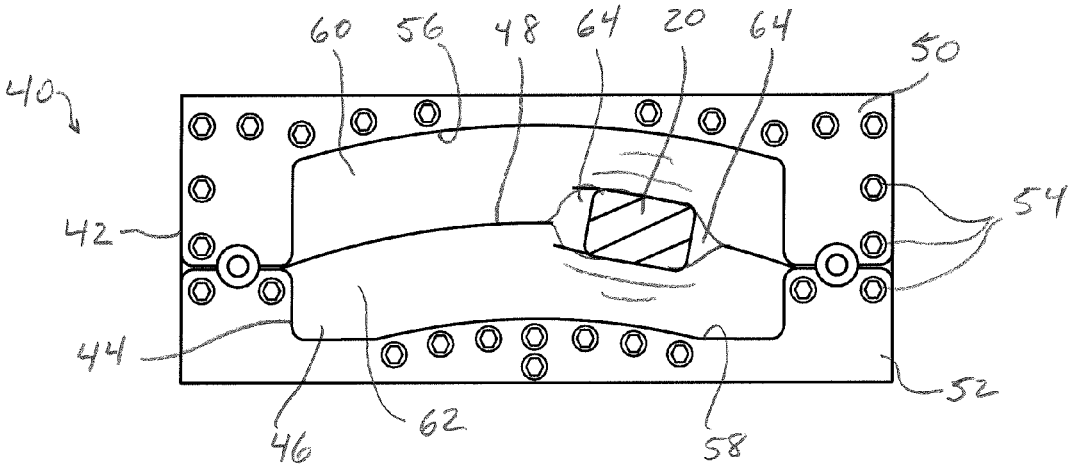
FIG. 5 is a front view of the hot air deflector assembly of the vibratory compactor of FIG. 1 with the hitch link in a right turn position.

In many implementations of articulated steering mechanisms, the top hitch link 20 moves through an arc-shaped path as the articulated frame 16 rotates from side-to-side. An example of such an arc-shaped path is shown in FIGS. 3-5. To accommodate such an arc-shaped path, the panel slot 48, the upper edge 56, and the lower edge 58 may be shaped to conform to the path of motion of the top hitch link 20. For example, the panel slot 48 may be shaped such that the center of the top hitch link 20 lies along the contour of the panel slot 48 as the top hitch link 20 moves to the left (FIG. 4) and to the right (FIG. 5). Further, where the top hitch link 20 sweeps out an arc having a constant radius, the panel slot 48 and edges 56, 58 may be shaped with complimentary arcs. As shown in FIG. 3, the panel slot 48 may have an arc with a first or slot radius $R_s$ from an origin O, the upper edge 56 may have an arc with a second or upper edge radius $R_{ue}$ from the origin O, and the lower edge 58 may have an arc with a third or lower edge radius $R_{le}$ from the origin O. With this configuration, the arcs defined by the panel slot 48, upper edge 56 and lower edge 58 are concentric with constant distances between the panel slot 48 and the upper edge 56, and between the panel slot 48 and the arc-shaped portion of the lower edge 58. As shown in the illustrated embodiment, the slot radius $R_s$ may also be the radius of curvature of the top hitch link 20 such that the geometric center of the top hitch link 20 remains centered along the panel slot 48 as the top hitch link 20 moves through its range of motion as the articulated frame 16 rotates.

While the preceding text sets forth a detailed description of numerous different embodiments of the invention, it should be understood that the legal scope of the invention is defined by the words of the claims set forth at the end of this patent. The detailed description is to be construed as exemplary only and does not describe every possible embodiment of the invention since describing every possible embodiment would be impractical, not impossible. Numerous alternative embodiments could be implemented, using either current technology or technology developed after the filing date of this patent, which would still fall within the scope of the claims defining the invention.

What is claimed is:

1. An engine hot air deflector for a work machine having a main body with an internal combustion engine disposed therein, and an articulated steering mechanism including an articulated frame pivotally coupled to the main body by a hitch assembly having a hitch link pivotally connected between the main body and the articulated frame, wherein the hitch link extends through an open end of the main body, the engine hot air deflector comprising:

a resilient hot air deflector panel configured to be mounted to the main body proximate the open end, the hot air deflector panel comprising:

an upper panel portion, a lower panel portion, and a panel slot there between configured to receive the hitch link there through so that the upper panel portion and the lower panel portion conform to a shape of the hitch link as the hitch link moves within the open end of the main body during rotation of the articulated frame to steer the work machine to substantially prevent hot air from the internal combustion engine from passing through the open end of the main body.

2. The engine hot air deflector of claim 1, comprising a support bracket configured to be connected to the main body of the work machine proximate the open end of the main body, the support bracket having a deflector opening there through configured for the hitch link to pass there through, wherein the support bracket and the hot air deflector panel are configured for the support bracket to mount the hot air deflector panel to the main body with the hot air deflector panel overlaying the deflector opening.

3. The engine hot air deflector of claim 2, wherein the support bracket comprises:

an upper bracket portion defining an upper edge of the deflector opening; and a lower bracket portion defining a lower edge of the deflector opening.

4. The engine hot air deflector of claim 2, wherein the deflector opening has a lower edge having a first radius of curvature and an upper edge having a second radius of curvature, and the panel slot has a third radius of curvature, wherein the lower edge, the upper edge and the panel slot are concentric.

5. The engine hot air deflector of claim 2, wherein the upper panel portion and the lower panel portion are fabricated from separate pieces of resilient material that are separated by the panel slot, and wherein the support bracket comprises:

an upper bracket portion defining an upper edge of the deflector opening and having the upper panel portion connected thereto; and a lower bracket portion defining a lower edge of the deflector opening and having the lower panel portion connected thereto.

6. The engine hot air deflector of claim 1, wherein the hitch link moves through a curved path as the articulated frame rotates to steer the work machine, and wherein the panel slot has a curvature corresponding to the curved path of the hitch link.

7. The engine hot air deflector of claim 1, wherein the upper panel portion and the lower panel portion are fabricated from a unitary piece of resilient material, and the panel slot is cut in the unitary piece of resilient material.

8. The engine hot air deflector of claim 1, wherein the upper panel portion and the lower panel portion are fabricated from separate pieces of resilient material that are separated by the panel slot.

9. The engine hot air deflector of claim 1, wherein the hot air deflector panel is fabricated from a resilient material.

10. A work machine, comprising:

a main body having an open end;

an internal combustion engine disposed within the main body;

an articulated steering mechanism, comprising:

an articulated frame, a hitch assembly pivotally coupling the articulated frame to the main body, and a hitch link pivotally connected between the main body and the articulated frame and extending though the open end of the main body; and a resilient hot air deflector panel mounted to the main body proximate the open end, the hot air deflector panel comprising:

an upper panel portion, a lower panel portion, and a panel slot there between configured to receive the hitch link there through so that the upper panel portion and the lower panel portion conform to a shape of the hitch link as the hitch link moves within the open end of the main body during rotation of the articulated frame to steer the work machine to substantially prevent hot air from the internal combustion engine from passing through the open end of the main body.

11. The work machine of claim 10, comprising a support bracket connected to the main body of the work machine proximate the open end of the main body, the support bracket having a deflector opening there through with the hitch link passing through the deflector opening, wherein the support bracket mounts the hot air deflector panel to the main body with the hot air deflector panel overlaying the deflector opening.

12. The work machine of claim 11, wherein the support bracket comprises:

an upper bracket portion defining an upper edge of the deflector opening; and a lower bracket portion defining a lower edge of the deflector opening.

13. The work machine of claim 11, wherein the deflector opening has a lower edge having a first radius of curvature and an upper edge having, a second radius of curvature, and the panel slot has a third radius of curvature, wherein the lower edge, the upper edge and the panel slot are concentric.

14. The work machine of claim 11, wherein the upper panel portion and the lower panel portion are fabricated from separate pieces of resilient material that are separated by the panel slot, and wherein the support bracket comprises:

an upper bracket portion defining an upper edge of the deflector opening and having the upper panel portion connected thereto; and a lower bracket portion defining a lower edge of the deflector opening and having the lower panel portion connected thereto.

15. The work machine of claim 10, wherein the hitch link moves through a curved path as the articulated frame rotates to steer the work machine, and wherein the panel slot has a curvature corresponding to the curved path of the hitch link.

16. The work machine of claim 10, wherein the upper panel portion and the lower panel portion are fabricated from a unitary piece of resilient material, and the panel slot is cut in the unitary piece of resilient material.

17. The work machine of claim 10, wherein the upper panel portion and the lower panel portion are fabricated from separate pieces of resilient material that are separated by the panel slot.

18. The work machine of claim 10, wherein the hot air deflector panel is fabricated from a resilient material.

19. The work machine of claim 10, wherein the main body includes hot air vents through a lateral side of the main body in fluid communication with the interior of the main body for discharge of hot air generated by the internal combustion engine.

* * * * *